US010144574B2

(12) United States Patent
Williams

(10) Patent No.: US 10,144,574 B2
(45) Date of Patent: Dec. 4, 2018

(54) SPILL GUARD SELECT DISPENSER FOR THE PREVENTION OF PILL SPILLAGE

(71) Applicant: Toxie Williams, Seminary, MS (US)

(72) Inventor: Toxie Williams, Seminary, MS (US)

( * ) Notice: Subject to any disclaimer, the term of this patent is extended or adjusted under 35 U.S.C. 154(b) by 0 days.

(21) Appl. No.: 14/674,075

(22) Filed: Mar. 31, 2015

(65) Prior Publication Data

US 2017/0275081 A1 Sep. 28, 2017

(51) Int. Cl.

| | |
|---|---|
| ***B65D 83/04*** | (2006.01) |
| ***A61J 7/00*** | (2006.01) |
| ***A61J 1/03*** | (2006.01) |
| ***B65D 50/04*** | (2006.01) |

(52) U.S. Cl.

CPC ..... *B65D 83/0409* (2013.01); *A61J 1/03* (2013.01); *A61J 7/0076* (2013.01); *B65D 50/046* (2013.01)

(58) Field of Classification Search

None

See application file for complete search history.

(56) References Cited

U.S. PATENT DOCUMENTS 3,918,607 A * 11/1975 Rowlette ..... B65G 59/067 221/15
4,714,181 A * 12/1987 Kozlowski ..... B65D 41/045 215/237
4,782,981 A * 11/1988 Schuster ..... B65D 83/0409 206/540
5,484,089 A 1/1996 Picerno
5,772,086 A * 6/1998 Krafft ..... G01F 11/24 222/438
7,147,130 B1 12/2006 Clark
8,757,382 B1 6/2014 Crawford
2008/0251531 A1* 10/2008 Coe ..... B65D 83/0454 221/265
2011/0031261 A1* 2/2011 Singh ..... B65D 83/0454 221/1
2013/0116818 A1* 5/2013 Hamilton ..... A61J 7/04 700/236

* cited by examiner

*Primary Examiner* — Gene O Crawford
*Assistant Examiner* — Ayodeji T Ojofeitimi
(74) *Attorney, Agent, or Firm* — Michael C. Williams; Bradley Arant Boult Cummings, LLP

(57) ABSTRACT

An insert used in conjunction with a pill container consisting of a circular alignment plate or dialer and base. The alignment plate contains a plurality of opening of various sizes and shapes. The circular base contains one opening, preferably equal in size and shape to the largest opening on the alignment plate or dialer. The two components are connected at the center point so that the dialer or alignment plate may rotate to align one of the openings on the alignment plate with the opening of the base. The alignment of the openings allows the user to control, limit or restrict the dispensing of pills located in the container while also providing addition safeguards.

9 Claims, 3 Drawing Sheets

SPILL GUARD SELECT DISPENSER FOR THE PREVENTION OF PILL SPILLAGE

CROSS-REFERENCE TO RELATED APPLICATIONS

This application claims the benefit of U.S. Provisional Application No. 61/975,194, under 35 U.S.C. § 119(e), filed Apr. 4, 2014, the disclosure of which is incorporated herein by reference.

STATEMENT REGARDING FEDERALLY SPONSORED RESEARCH OR DEVELOPMENT

Not Applicable.

REFERENCE TO SEQUENCE LISTING, TABLE, OR A COMPUTER PROGRAM, LISTING COMPACT DISC APPENDIX

Not Applicable.

BACKGROUND OF INVENTION

Delivery of a pill has traditionally been accomplished by simply removing the safety-locking caps and tilting the container, leading to the uncontrolled dispensing of a large number of pills, exceeding the dosage required by the user. Often this leads to the spillage of pills, and the tedious task of recovering the pills from the floor, counter, or countless other locations the pills have fallen and placing them back within the container.

In addition to the user manually unlocking the top and retrieving the medication, often the user may fail to adequately secure the cap, leading to more than a simple annoyance, but ultimately a health hazard for young loved ones and pets. This also leads to inadvertent spillage of pills in one's purse or traveling bag, resulting in lost pills, or worse, ingestion by some 67,000 children who visit an emergency room, because of spilled pill ingestion. In fact, this happens once every eight minutes.

A number of past devices have attempted to provide a method for 1) controlling the dosage of pills, and 2) additional child and pet safety. Often such devices involve complex chambers or limit the size or type of pill that can be dispensed. Other methods attempt to accomplish this task by limiting the number of pills to a single dose, but this method lacks the flexibility and functionality that allows the user to manually adjust the flow of the pills, while maintaining the added protection needed to prevent spillage and ultimately ingestion by an unintended user.

The Spill Guard Select Disperser provides an inexpensive, versatile insert that allows the manufacturer to include several options for the controlled delivery of the pill, while also serving as an additional safety mechanism to prevent the unintended spillage of pills. This insert is then placed inside of the standard circular opening of a pill container that one receives from a pharmacy, or for over the counter medications, such as your standard Advil or Tylenol bottle at a height desired by the user. Once placed inside of the chosen container, the insert's unique design prevents removal by young children and pets.

Further, as a result of its simple installation, the user may individually purchase the insert in various sizes to insert in an array of pill containers that include a circular opening.

Although prior art contains control and safety mechanisms, it lacks the ability to provide additional measures to protect small children and pets if the medication bottle is open.

In addition, prior art lacks the capability to provide the controlled dispensing insert in a form that is compatible with a number of containers without changing any characteristics of existing containers.

Moreover, the Spill Guard Select Dispenser again goes beyond prior art, providing a locking mechanism that requires manual depressing of the tab to freely rotate the dialer or alignment plate. This embodiment consists of a vertical member affixed to the base member. This vertical member sits parallel to the axis of rotation of the dialer or alignment plate, allowing the vertical member to shift into an opening on the dialer or alignment plate to create a "lock," preventing any rotation by the dialer.

Finally, the Spill Guard Select Dispenser goes beyond the prior art by providing an additional locking mechanism in the form of a spring tension lock.

BRIEF SUMMARY OF THE INVENTION

The principle invention, as claimed, relates to containers used for the storage of medication in pill form. Specifically, this invention relates to improvements to devices used to contain and/or limit the spillage of pills from containers with a circular opening where the pills are dispersed. This invention is inserted into the circular opening at a location suitable to the user to control, limit and/or restrict the flow of pills from the container when the container cap is removed or left in an unsecured or unlocked position as intended. Without the claimed invention, there is no method to manage the number of pills dispensed or prevent the spillage of pills if the cap is not securely fastened, resulting in spillage, lost medication, and often ingestion by small children and pets.

This invention is also useful for elderly citizens who experience issues with fine motor skills, making it difficult to extract pills from designated storage containers.

The claimed invention consists of a cylindrical base containing an opening allowing for the dispersing of pills and a circular rotatable "dialer" or "alignment plate" with varying sized openings to account for various pill sizes to be dispensed. The dialer or alignment plate is affixed to the base so that the dialer or alignment plate may rotate, unobstructed, about the center of both components to align the various openings, located on the dialer or alignment plate, with the opening on the base.

The feature allowing for the unobstructed rotation of the dialer or alignment plate allows the user to choose the appropriate opening for the correct pill size or control the rate at which the pills are dispensed by selecting a larger opening. This feature also provides additional safety as young children and pets struggle to correctly adjust the dialer, or alignment plate, to the correct setting should the container be found without the cap. The dialer, or alignment plate, and base are connected at the central point of rotation. This completed insert can be implanted, with the dialer or alignment plate facing the opening of the container, vertically at various locations throughout the container for additional safety due to the length of small children's fingers.

Additionally, this device can also be fitted with a locking mechanism that provides additional protection for users, preventing ingestion of pills by small children and again, providing additional protection in the event the cap is not securely fastened.

This locking mechanism may be achieved by two methods. The first method requires the addition of a manual "lock." This lock is created when the user manually places the vertical member in the cutout contained in the dialer or alignment plate. When the vertical member is in this position the openings in the dialer or alignment plate are not aligned with that of that base, preventing the dispensing of pills.

The second method involves the use of a spring loaded tension mechanism. The resistance of the spring locks the dialer or alignment plate in a position that prevents the dispensing of pills by prohibiting the alignment of the openings of the dialer or alignment plate to align with the opening of the base. The user must then physically apply force to the dialer or alignment plate to align the proper openings and remain in that alignment.

While the illustrated and discussed aspects in the disclosure are amendable to various modifications, and alternative forms, various embodiments have been shown by way of example in drawings and will be described in detail. It should be understood, however, that the intention is not to limit the disclosure to the particular embodiments described. On the contrary, the intention is to cover all modifications, equivalents, and alternatives falling within the spirit or scope of the invention.

FIELD

This invention is directed to the field of pill dispensing mechanisms, and container safety and more particularly pertains to allowing an individual to readily dispense pills and the like, for use with an insert that allows the user to both control the dispensing of the pill and also add additional safeguards, preventing spillage in the event the container is improperly locked.

DETAILED DESCRIPTION OF INVENTION

The present disclosure is directed to overcoming the previously mentioned challenges and issues related to the controlled dispensing of pills, using an array of devices and methods. The current disclosure exhibits in a number of implementations and applications, the ability of such device which is summarized below.

The present invention is composed primarily of two main components which interact to provide the user with the capability to control the dispensing of the pills located in the container, as well as providing several additional layers of protection, without destructing or adjusting pre-existing caps/technology.

It also contains the versatility that allows it to be used in a number of pill containers either supplied by pharmacists or over-the-counter medication.

Figure 1A:
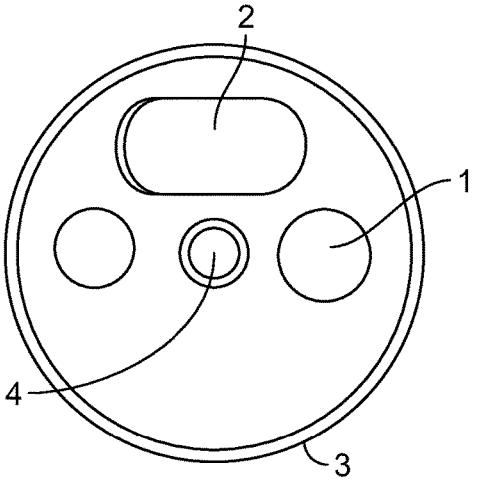
FIG. 1A. Shows the dialer or alignment plate with a large opening and two small openings, as well as the center rotation point.
Figure 1B:
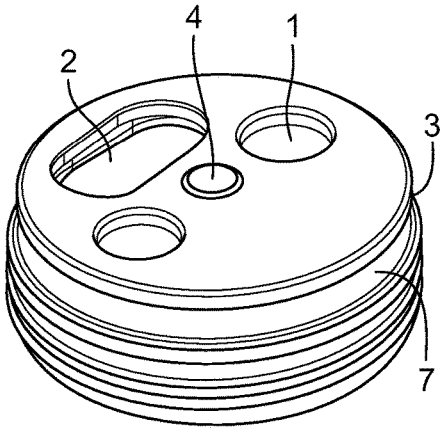
FIG. 1B. Shows the dialer or alignment plate affixed to the base without locking mechanism.
Figure 1C:
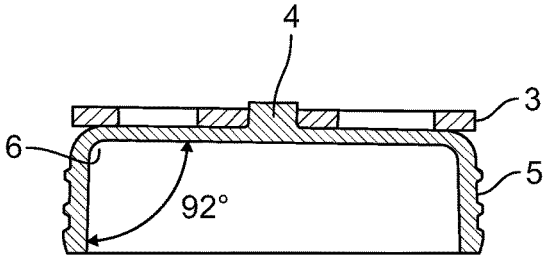
FIG. 1C. Shows a cross sectional of the dialer or alignment plate affixed to the base.
Figure 1E:
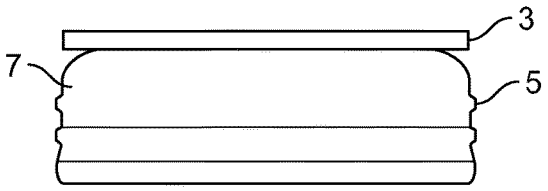
FIG. 1E. Depicts a side view of the base and dialer or alignment plate with sample measurements showing the slight expansion of the base.

The device first consists of a dialer or alignment plate that is a circular plate with a plurality of openings. In FIG. 1A it shows the alignment plate (3), a large opening (2), and two smaller openings (1). The varying sized openings allow for the user to control and/or restrict the dispensing of the pills based on the pill size or number of pills desired by the user.

The device also consists of a second component known as the base (7). The base (7) is constructed as a cylinder, or more likely a truncated cone, with a circular top surface that extends downward at an angle greater than 90° (6) resulting in a greater circumference and diameter for the lower portion of the base. This feature allows the user to implant the insert into the desired pill container for a tight fit along the inner circumferential wall of the pill container. Also contained on the base (7), are several elevated ridges (5) that aid in securing the position within the pill container, preventing removal by a pet or young child.

Figure 1D:
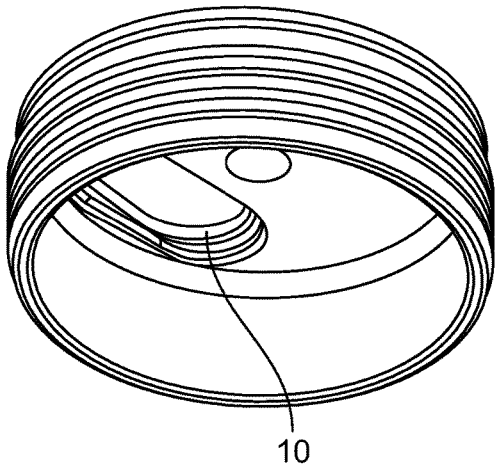
FIG. 1D. Depicts the bottom isometric view of the base depicting the single opening located on the base.

Also located on the base (7), as pictured in FIG. 1D, is a second large opening (10) for the dispensing of pills dependent on the placement of the alignment plate. If this second large opening (10), is aligned with the first large opening (2), on the alignment plate or dialer (3), this will permit the user to allow the maximum number of pills to be dispensed. However, if one of the smaller openings (1), is aligned with the second large opening (10), it will potentially reduce the flow/dispensing of the pill located in the container.

The alignment plate of the dialer (3) is then affixed to the base (7) at a central location (4), the center point of both components. The connection is one such that it allows the dialer or alignment plate (3) to rotate at the discretion of the user to obtain the desired opening size.

Figure 2A:
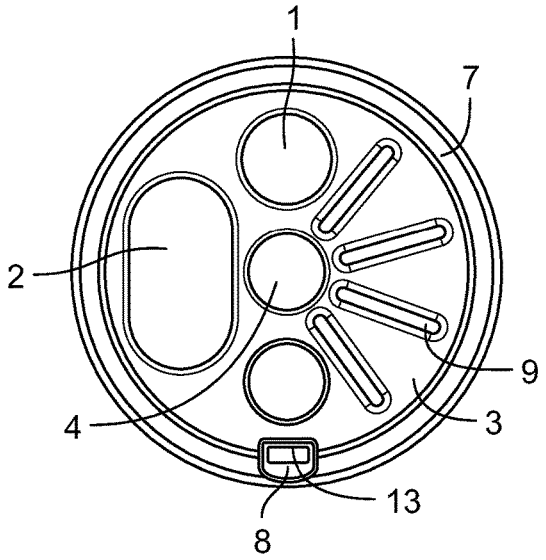
FIG. 2A. Shows the top view of the dialer or alignment plate and base with the added locking mechanism and elevated markings.

As the user is capable of placing the insert at various locations vertically within the pull container, the dialer or alignment plate (3) also contain the elevated ridges (9), as seen in FIG. 2A, that allows the user to apply the needed force to rotate the alignment plate or dialer (3).

Figure 2B:
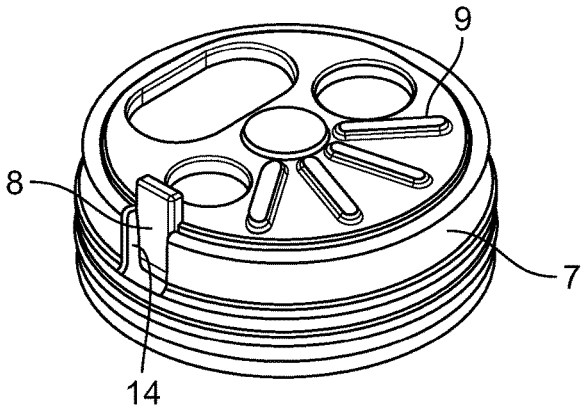
FIG. 2B. Depicts an isometric view of the connected dialer or alignment plate and base with locking mechanism.
Figure 2C:
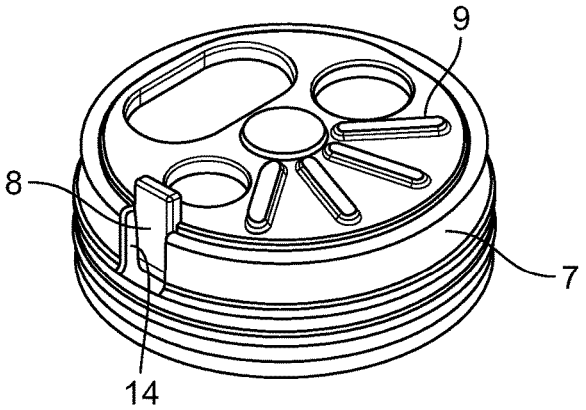
FIG. 2C. Depicts an isometric view of the connected dialer and base with locking mechanism and elevated markings.
Figure 2D:
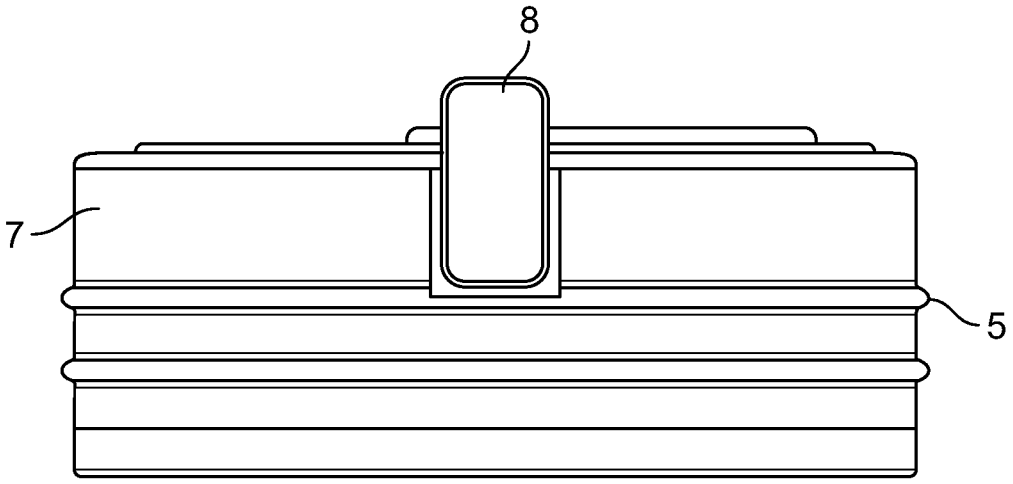
FIG. 2D. Depicts a side view of the connected dialer or alignment plate and base with a view of the locking mechanism.
Figure 2E:
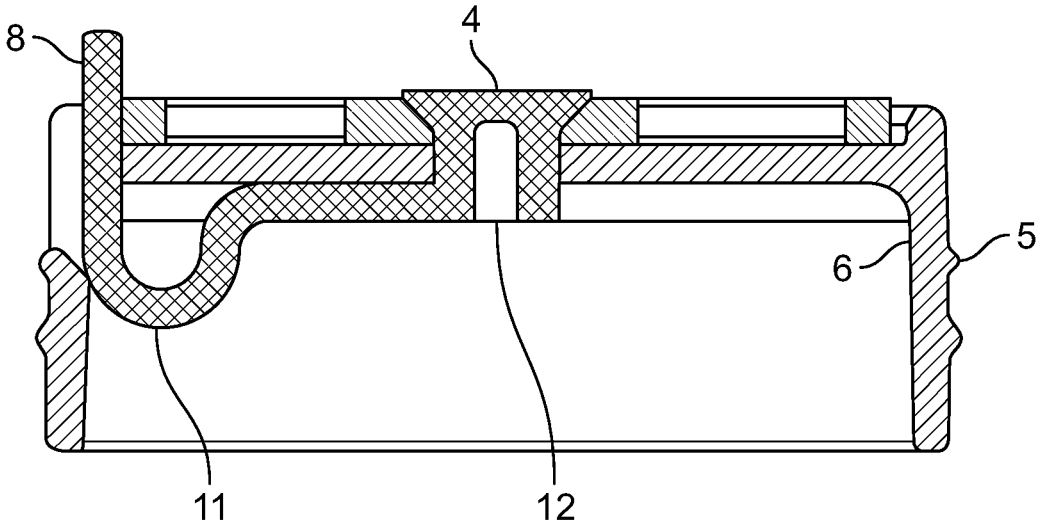
FIG. 2E. Depicts a cross sectional view of the insert with a view of the location of the spring tension lock.

In addition to the previously described embodiment, if the user desires more security, the completed insert may be fitted with a vertical member (8), seen in FIG. 2B, FIG. 2C and FIG. 2D. This vertical member serves as a locking mechanism This embodiment contains the same features; however, the alignment plate or dialer (3), which is circular, now contains a small rectangular cutout along the outer circumference of the circle.

The base (7) is also fitted with a rectangular cutout (14) located on the outer circumference of the base. Also, at a point affixed to the inner circumference of the base (7), is a hinge or similarly functioning device (11). The purpose of this hinge or apparatus (11) is to allow the vertical member (8) to alternate between two positions: "open" and "locked."

The first position or "locked" position requires that the vertical member (8) is lodged in the previously described cutout (13) located on the alignment plate or dialer (3). The cutout (13) is positioned so that when the vertical member (8) is engaged in the "locked" position as seen in FIG. 2C, the small openings (1) and the first large opening (2) are not aligned with the second large opening (10) located on the base (7). This prohibits the dispensing of any pills at that time.

The second position or "open" position requires that the vertical member (8) is located in the previously described cutout (14) on the base (7). The previously described greater than 90° angle (6) allows for enough space between the inner circumferential wall of the pill container and the cutout (14) and outer circumferential wall of the upper portion of the base, so that the vertical member (8) may be placed in the cutout (14) without obstructing the rotation of the alignment plate or dialer (3), as pictured in FIG. 2B.

In addition to previously described features, the insert may be equipped with a spring or tension closing at location (12). This feature uses the resistance generated by the spring to maintain the dialer in a predeteunined "closed" location that prevents the alignment of the opening on the alignment plate or dialer (3) with that of the base (7). With this embodiment, the user must apply force to the alignment plate or dialer (3) to position either one of the small openings (1) or the first large opening (2) with the second large opening (10), located on the base (7) to allow the delivery or dispensing of the pill. Upon removal of the force the resistance of the spring returns the dialer (3) to the previous "closed" position.

The completed insert is then placed inside the pill container, with the alignment plate or dialer (3) facing the opening of the pill container, and the lower outer circumference of the base touching the inner wall of the pill container, at a height of the user's choice. The insert remains lodged in the container due to the design of the base which is equipped with the ridges (5) along the circumference of the base. These ridges (5) allow the insert to remain in the desired location without fear that a young child or pet will remove the insert.

The various embodiments described above are provided by way of illustration only and should not be constructed to limit the invention. Based on the above discussion and illustrations, those skilled in the art will readily recognize the various modifications and changes that may be made to the present disclosure without strictly following the exemplary embodiments and applications illustrated and described herein. Such modifications and changes do not depart from the true spirit and scope of the present invention.

DRAWINGS

Not Applicable.

OATH OR DECLARATION

Not Applicable.

SEQUENCE LISTING

Not Applicable

The invention claimed is:

1. A pill dispensing apparatus comprising: a base, alignment plate and locking mechanism;

wherein the alignment plate having at least one opening;

wherein the base also has an opening;

wherein the alignment plate is affixed to the top of the base at a central point and the alignment plate rotates about the central point relative to the base; and wherein the locking mechanism is a vertical member attached to an element extending from the central point via a hinge that prevents rotation of the alignment plate.

2. The apparatus of claim 1, wherein the base is the shape of a truncated cone.

3. The apparatus of claim 2, wherein the base contains a plurality of ridges wherein each ridge encircles the outer circumference of the base.

4. The apparatus of claim 3, wherein a second opening on the alignment plate is larger than the first opening.

5. The apparatus of claim 4, wherein the opening on the base is equal in shape and size to the larger opening on the alignment plate.

6. The apparatus of claim 5, wherein the alignment plate also contains a plurality of elevated ridges.

7. The apparatus of claim 6, wherein the apparatus is placed into the opening of a pill bottle and the plurality of ridges press against the inner wall of the pill bottle.

8. The apparatus of claim 7, wherein the alignment plate also contains a rectangular cutout on the outer circumference of the alignment plate.

9. The apparatus of claim 8, wherein the base also contains a rectangular cutout.

* * * * *